US008656708B2

(12) United States Patent
Morley et al.

(10) Patent No.: US 8,656,708 B2
(45) Date of Patent: Feb. 25, 2014

(54) COAXIAL INLET AND OUTLET EXHAUST TREATMENT DEVICE

(75) Inventors: Nicholas Morley, Pinckney, MI (US); Lawrence Dalimonte, Bath, MI (US); Jagandeep Sandhu, Canton, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 71 days.

(21) Appl. No.: 13/316,872

(22) Filed: Dec. 12, 2011

(65) Prior Publication Data

US 2012/0192551 A1 Aug. 2, 2012

Related U.S. Application Data

(60) Provisional application No. 61/437,896, filed on Jan. 31, 2011.

(51) Int. Cl.
*F01N 3/10* (2006.01)

(52) U.S. Cl.
USPC ..... 60/303; 60/286; 60/295; 60/299; 431/5; 431/259; 431/353; 431/365

(58) Field of Classification Search
USPC ..... 60/274, 286, 295, 297, 299, 303; 431/5, 431/259, 351, 353, 365
See application file for complete search history.

(56) References Cited

U.S. PATENT DOCUMENTS

| | | | | |
|---|---|---|---|---|
| 3,603,080 | A * | 9/1971 | McCrocklin | 60/303 |
| 5,320,523 | A * | 6/1994 | Stark | 431/353 |
| 5,339,630 | A * | 8/1994 | Pettit | 60/303 |
| 5,417,059 | A * | 5/1995 | Hartel et al. | 60/276 |
| 5,826,428 | A * | 10/1998 | Blaschke | 60/303 |
| 7,513,921 | B1 | 4/2009 | Phelps et al. | |
| 7,610,752 | B2 | 11/2009 | Dalla Betta et al. | |
| 7,628,011 | B2 | 12/2009 | Crawley et al. | |
| 7,685,811 | B2 * | 3/2010 | Taylor et al. | 60/277 |
| 7,797,927 | B2 | 9/2010 | Nagaoka et al. | |
| 7,845,166 | B2 | 12/2010 | Kotrba et al. | |
| 7,896,645 | B2 * | 3/2011 | Loving | 431/5 |
| 2009/0255242 | A1 | 10/2009 | Paterson et al. | |
| 2009/0277164 | A1 | 11/2009 | Arellano et al. | |
| 2010/0269492 | A1 | 10/2010 | Kotrba et al. | |

FOREIGN PATENT DOCUMENTS

| | | |
|---|---|---|
| JP | 09-228830 | 9/1997 |
| JP | 2010-025112 | 2/2010 |

* cited by examiner

*Primary Examiner* — Binh Q Tran
(74) *Attorney, Agent, or Firm* — Harness, Dickey & Pierce, P.L.C.

(57) ABSTRACT

A burner for an exhaust gas treatment system treats an exhaust flow from an engine and includes an inner housing defining a primary combustion zone and a secondary combustion zone. The inner housing includes a plurality of apertures upstream of the secondary combustion zone for receipt of a first portion of the exhaust flow. An outer housing surrounds the inner housing to define a bypass flow path between the inner and outer housings to bypass a second portion of the exhaust flow around the inner housing outside of the primary and secondary combustion zones. The outer housing includes an exhaust inlet coaxially aligned with an exhaust outlet along a central longitudinal axis. A mixing zone is provided downstream of the second combustion chamber in receipt of the first and second portions of the exhaust flow.

12 Claims, 5 Drawing Sheets

COAXIAL INLET AND OUTLET EXHAUST TREATMENT DEVICE

CROSS-REFERENCE TO RELATED APPLICATIONS

This application claims the benefit of U.S. Provisional Application No. 61/437,896, filed on Jan. 31, 2011. The entire disclosure of the above application is incorporated herein by reference.

FIELD

The present disclosure relates to an exhaust gas treatment device, and more particularly, to a burner within a system for reducing oxides of nitrogen and particulate matter emissions from diesel compression engines.

BACKGROUND

Governmental bodies continue to call for a reduction in the nitrogen oxides ($NO_x$) and particulate matter (PM) emitted from diesel combustion processes, and in particular from diesel compression engines. While diesel particulate filters (DPF) are capable of achieving the required reductions in PM, which is typically a form of soot, there is a continuing need for improved systems that can provide the required reductions in $NO_x$, often in connection with the PM reduction provided by a DPF.

Systems have been proposed to provide a diesel oxidation catalyst (DOC) upstream from a DPF in order to provide an increased level of $NO_2$ in the exhaust which reacts with the soot gathered in the DPF to produce a desired regeneration of the DPF. This method may be referred to as passive regeneration. However, such systems may have limited effectiveness at temperatures below 300° C. and typically produce a pressure drop across the oxidation catalyst that must be accounted for in the design of the rest of the system. Additionally, or alternatively, fuel, such as hydrogen or a hydrocarbon fuel, can be delivered upstream of the DOC to generate temperatures greater than 600° F. and actively regenerate the DPF.

Some systems include a burner to ignite and combust unburned fuel that remains in the exhaust downstream from the diesel combustion process. Examples of such proposals are shown in commonly assigned and co-pending U.S. patent application Ser. No. 12/430,194, filed Apr. 27, 2009, entitled "Diesel Aftertreatment System" by Adam J. Kotrba et al., the entire disclosure of which is incorporated herein by reference.

While current burners for such systems may by suitable for their intended purpose, improvements may be desirable. For example, it may be advantageous to provide a burner having an exhaust gas inlet coaxially aligned with the exhaust gas outlet to reduce back pressure and alleviate component packaging and mounting concerns.

SUMMARY

This section provides a general summary of the disclosure, and is not a comprehensive disclosure of its full scope or all of its features.

A burner for an exhaust gas treatment system treats an exhaust flow from an engine and includes an inner housing defining a primary combustion zone and a secondary combustion zone. The inner housing includes a plurality of apertures upstream of the secondary combustion zone for receipt of a first portion of the exhaust flow. An outer housing surrounds the inner housing to define a bypass flow path between the inner and outer housings to bypass a second portion of the exhaust flow around the inner housing outside of the primary and secondary combustion zones. The outer housing includes an exhaust inlet coaxially aligned with an exhaust outlet along a central longitudinal axis. A mixing zone is provided downstream of the second combustion chamber in receipt of the first and second portions of the exhaust flow.

A burner for an exhaust gas treatment system treats an exhaust flow from an engine and includes a tubular inner housing having a closed upstream end and a central axis. The inner housing defines a combustion flow path to direct a first portion of the exhaust flow through a combustion zone wherein unburned fuel carried in the exhaust is ignited. A tubular outer housing includes an exhaust inlet coaxially aligned with the central axis. The outer housing surrounds the inner housing and defines a bypass flow path across the closed end and between the inner and outer housings to bypass a second portion of the exhaust flow around the combustion zone. An injector tube is fixed to one of the inner housing and the outer housing and is in communication with a cavity of the inner housing.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
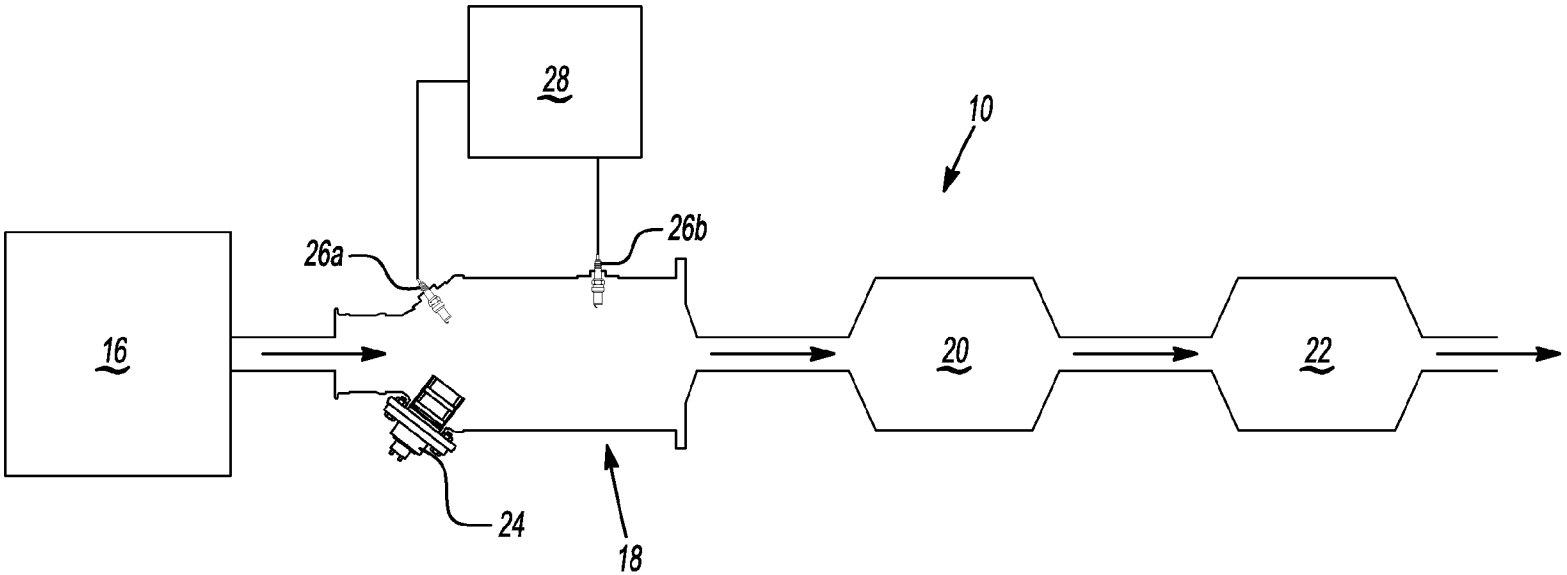
FIG. 1 is schematic depicting an exhaust gas treatment system including a burner constructed in accordance with the teachings of the present disclosure.

FIG. 1 depicts an exemplary diesel exhaust gas aftertreatment system 10 for treating the exhaust from a diesel compression engine 16. The exhaust may contain oxides of nitrogen ($NO_x$) such as nitric oxide (NO) and nitrogen dioxide ($NO_2$) among others, particular matter (PM), hydrocarbons, carbon monoxide (CO), and other combustion byproducts.

Aftertreatment system 10 includes a burner 18 that selectively increases the temperature of the exhaust by selectively igniting and combusting unburned fuel carried in the exhaust. The ability to provide the exhaust at an elevated temperature to the rest of the system 10 provides a number of advantages, some of which will be discussed in more detail below.

Aftertreatment system 10 may also include one or more other exhaust treatment devices, such as a diesel particulate filter (DPF) 20 connected downstream from the burner 18 to receive the exhaust therefrom, and a $NO_x$ reducing device 22, such as a selective catalytic reduction catalyst (SCR) or a lean $NO_x$ trap connected downstream from the DPF 20 to receive the exhaust therefrom.

Burner 18 is operable to increase the temperature of the exhaust of lean-burn engines, such as diesel compression engine 16, by employing an active regeneration process for the DPF 20 wherein fuel is ignited in the burner 18 to create a flame that heats the exhaust to an elevated temperature that will allow for oxidation of the PM in the DPF 20. Additionally, in connection with such active regeneration, or independent thereof, burner 18 may be used in a similar manner to heat the exhaust to an elevated temperature that will enhance the conversion efficiency of the $NO_x$ reducing device 22, particularly an SCR. Advantageously, burner 18 may provide elevated exhaust temperatures, either selectively or continuously, independent of a particular engine operating condition, including operating conditions that produce a low temperature (<300° C.) exhaust as it exits engine 16. Thus, aftertreatment system 10 can be operated without requiring adjustments to the engine controls.

Figure 2:
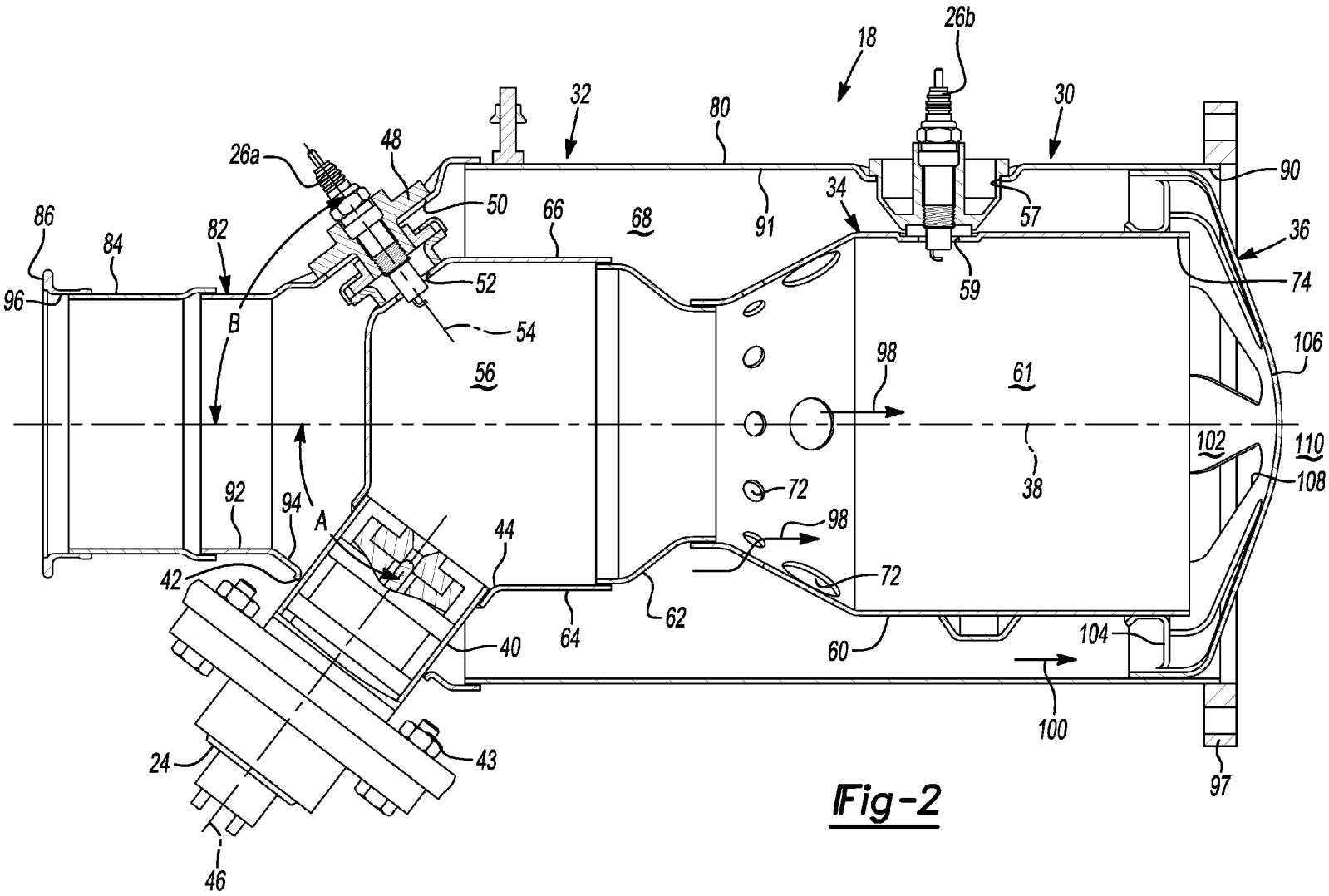
FIG. 2 is a cross-sectional view of the burner depicted in FIG. 1.

Burner 18 includes an injector 24 for injecting a suitable fuel and an oxygenator. The fuel may include hydrogen or a hydrocarbon. Injector 24 may be structured as a combined injector that injects both the fuel and oxygenator, as shown in FIG. 2, or may include separate injectors for the fuel and the oxygenator. Preferably, a control system, shown schematically at 28 in FIG. 1, is provided to monitor and control the flows through the injector 24 and the ignition by the igniters 26 using any suitable processor(s), sensors, flow control valves, electric coils, etc.

Figure 3:
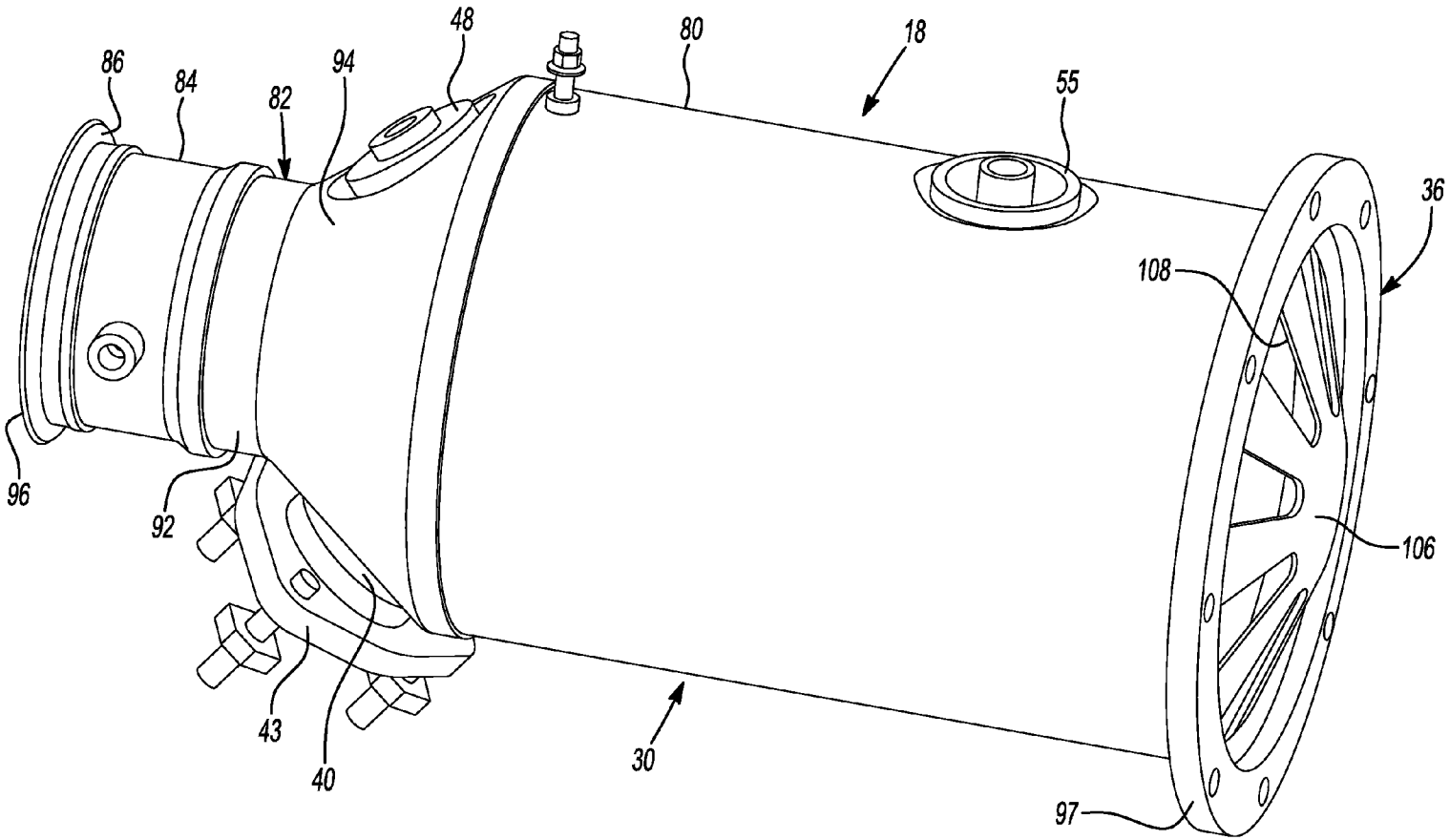
FIG. 3 is a perspective view of the burner.
Figure 4:
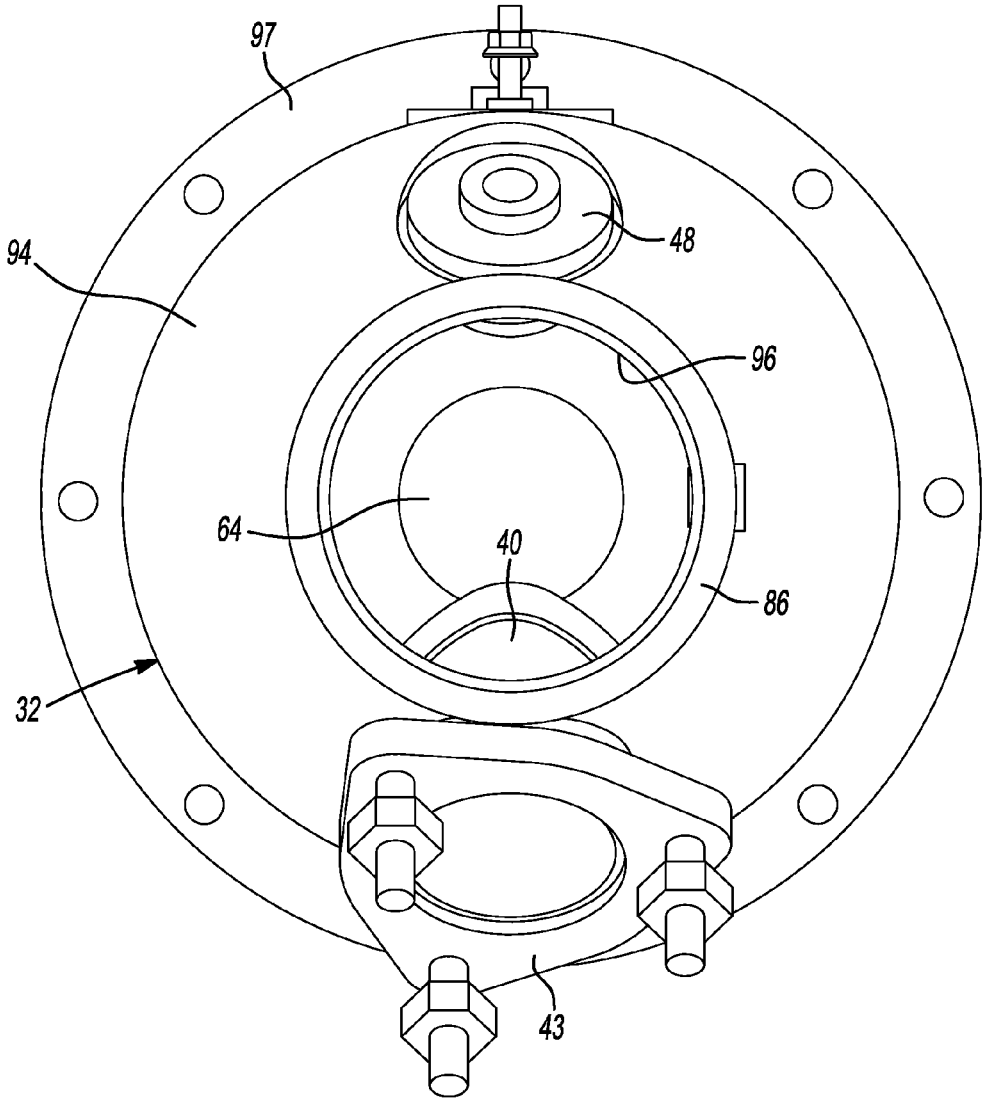
FIG. 4 is an end view of the burner.
Figure 5:
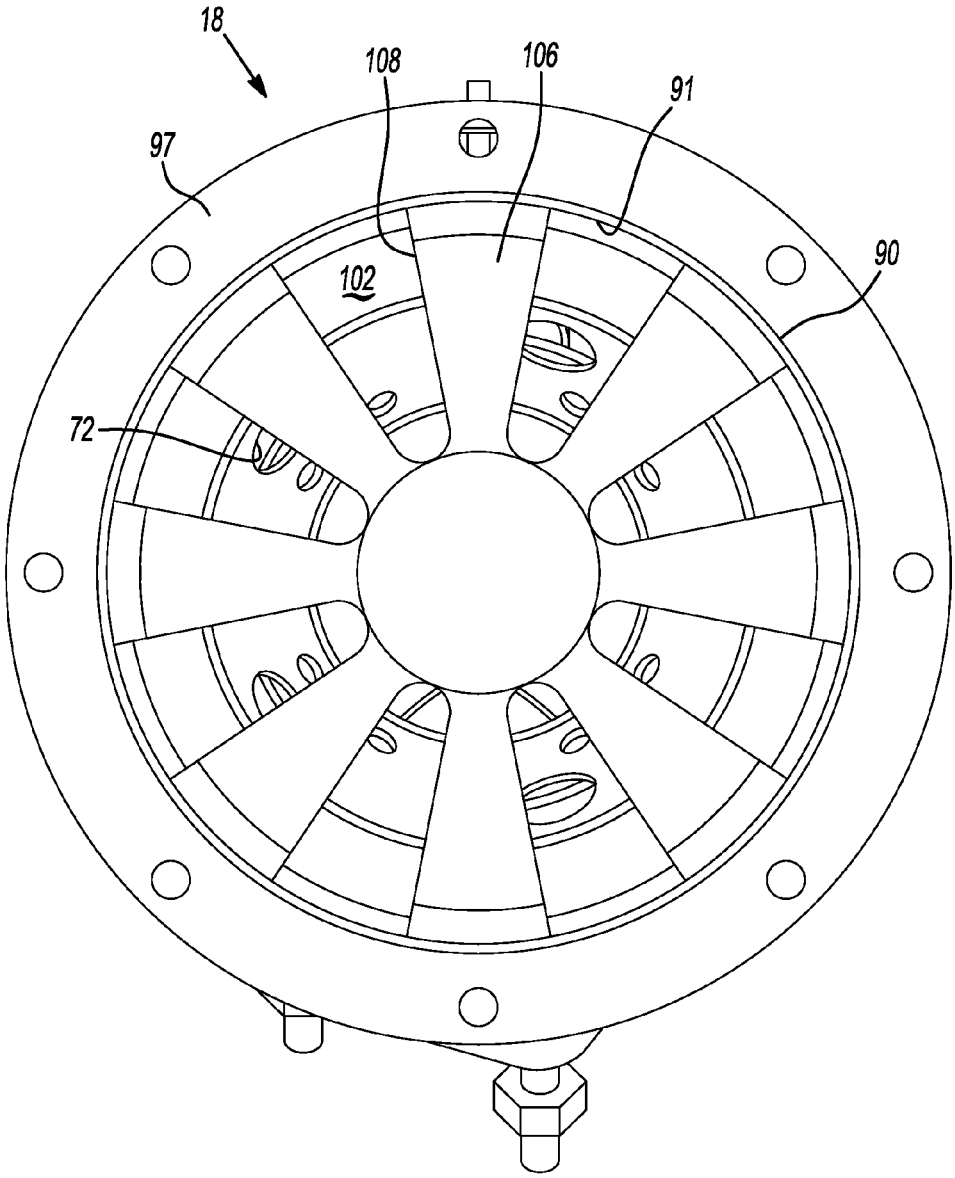
FIG. 5 is an opposite end view of the burner.

As shown in FIGS. 2-4, burner 18 includes a housing 30 constructed as a multi-piece assembly of fabricated sheet metal components. Housing 30 includes a cylindrically-shaped outer housing 32, a cylindrically-shaped inner housing 34 and a mixer 36 aligned on a central axis 38. An injector tube 40 extends through an aperture 42 in outer housing 32 as well as an aperture 44 in inner housing 34. An injector mount 43 is fixed to injector tube 40 to provide an attachment mechanism for injector 24. Atomized fuel is injected along an injection axis 46. Injection axis 46 intersects central axis 38 at an included angle "A." Angle "A" is shown as approximately 52 degrees. Spark plug 26*a* is fixed to outer housing 32 via a mount 48. An aperture 50 extends through outer housing 32 and another aperture 52 extends through inner housing 34 in receipt of spark plug 26*a*. Mount 48 may include portions positioned inside and outside outer housing 32. Spark plug 26*a* extends along an igniter axis 54 that intersects central axis 38 at an included angle "B." Angle "B" is also approximately 52 degrees. Spark plug 26*a* includes an end in communication with a first combustion chamber 56 defined by inner housing 34. Spark plug 26*b* is fixed to outer housing 32 via an igniter mount 55 and extends through apertures 57, 59 to be in communication with a second combustion chamber 61 defined by inner housing 34.

Inner housing 34 is depicted as a multi-piece sheet metal subassembly including an inner liner 60, a transition pipe 62 and an end cap 64 fixed to one another. End cap 64 includes a substantially uninterrupted outer surface 66 with the exception of apertures 44 and 52. An annular volume 68 exists in the space between outer housing 32 and inner housing 34. Transition pipe 62 is fixed to end cap 64 and inner liner 60 by a suitable process such as welding. Transition pipe 62 is a substantially contiguous uninterrupted member. Volume 68 is placed in fluid communication with second combustion chamber 61 via a plurality of apertures 72 extending through inner liner 60. Inner liner 60 also includes an open end 74.

Outer housing 32 is a multi-piece sheet metal fabrication including a cylindrical body 80, a cylindrical inlet cone 82, a sleeve 84 and an inlet flange 86 fixed to one another as depicted in the Figures. Inlet cone 82 includes a substantially circular cylindrical portion 92 and a conical portion 94. Both of these portions have a longitudinal axis coaxially aligned with central axis 38. Inlet flange 86 and sleeve 84 also include substantially circular cylindrical cross-sections having longitudinal axes aligned with central axis 38. Inlet flange 86 includes an inlet 96 in receipt of exhaust from engine 16. Cylindrical body 80 includes an open end 90 having a substantially circular cross-section that is also aligned on central axis 38. The coaxial arrangement of inlet 96 with open end 74 and open end 90 minimizes the exhaust pressure drop across burner 18. It should also be appreciated that inner liner 60, transition pipe 62 and end cap 64 have longitudinal axes that are commonly aligned with central axis 38. A mounting flange 97 is fixed to outer housing 32 to allow burner 18 to be directly fixed to a downstream exhaust treatment device such as DPF 20.

The shape and positioning of the components of outer housing 32 and inner housing 34 define engine exhaust paths that split and recombine with one another. More particularly, exhaust gas from an internal combustion engine is provided to inlet 96. Exhaust flows from left to right when viewing FIG. 2. As the exhaust continues to flow through inlet flange 86 and sleeve 84, the exhaust passes through annular volume 68 defined between the outer surfaces of inner housing 34, such as surface 66, and an inner surface 91 of outer housing 32. As the exhaust passes over end cap 64 and transition pipe 62, a portion of the engine exhaust travels along a combustion flow path 98. Exhaust travelling along combustion flow path 98 flows through apertures 72. During burner operation, fuel and oxygenator are supplied to first combustion chamber 56 by injector 24. Spark plug 26*a* functions as an igniter to produce a flame within first combustion chamber 56. Exhaust travelling along combustion flow path 98 is heated by the flame and unburned fuel carried in the exhaust is ignited by the flame and/or spark plug 26*b* within second combustion chamber 61.

The remaining portion of exhaust gas that does not pass through apertures 72 may be characterized as travelling along a bypass flow path 100. Exhaust flows through the volume 68 between inner housing 34 and outer housing 32 downstream of aperture 72. The exhaust flowing through bypass flow path 100 is supplied to a mixing zone 102 for combination with the combustion flow exiting combustion flow path 98.

Mixer 36 includes an end plate 104 and a mixing plate 106. End plate 104 extends across the bypass flow path 100 to restrict an available flow area of the bypass flow path 100. A plurality of elongated apertures 108 extend through mixing plate 106 to define an outlet 110. Outlet 110 is coaxially arranged with central axis 38. End plate 104 is fixed to interior surface 91 of the outer housing 32 to secure mixer 36 to burner 18. Mixer 36 may be constructed from a single, stamped piece of sheet metal. Alternatively, end plate 104 may be constructed separately from and subsequently fixed to mixing plate 106.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A burner for an exhaust gas treatment system to treat an exhaust flow from an engine, the burner comprising:

an inner housing having a closed upstream end, the inner housing surrounding a primary combustion zone and a secondary combustion zone, the inner housing including a plurality of apertures upstream of the secondary combustion zone for receipt of a first portion of the exhaust flow;

an outer housing surrounding the inner housing to define a bypass flow path between the inner and outer housings to bypass a second portion of the exhaust flow around the inner housing outside of the primary and secondary combustion zones, the outer housing including a conically-shaped portion surrounding a portion of the inner housing as well as an exhaust inlet coaxially aligned with an exhaust outlet along a central longitudinal axis;

an injector mounted to the conically-shaped portion of the outer housing at a position offset from the central longitudinal axis, the injector being operable to inject fuel into the primary combustion chamber toward the central longitudinal axis; and a mixing zone downstream of the second combustion chamber in receipt of the first and second portions of the exhaust flow.

2. The burner of claim 1 further including an igniter mounted to the conically-shaped portion of the outer housing and being circumferentially spaced apart from the injector, the igniter operable to ignite the fuel within the primary combustion chamber.

3. The burner of claim 2 wherein the conically-shaped portion includes an axis aligned with the exhaust inlet and exhaust outlet, the conically-shaped portion enlarging in a direction of exhaust flow.

4. The burner of claim 3 wherein the injector injects fuel along an axis intersecting the central longitudinal axis at an included angle of substantially 52degrees.

5. The burner of claim 1 further including a mixer combining both the first and second portions of the exhaust flow.

6. The burner of claim 5 wherein the mixer further comprises an annular flange mounted to an interior surface of the outer housing.

7. The burner of claim 1 wherein the inner housing and outer housing have cylindrical shapes and the bypass flow path has an annular cross-section defined between the inner and outer housings.

8. A burner for an exhaust gas treatment system to treat an exhaust flow from an engine, the burner comprising:

a tubular inner housing having a closed upstream end, a central axis, and defining a combustion flow path to direct a first portion of the exhaust flow through a combustion zone wherein unburned fuel carried in the exhaust is ignited;

a tubular outer housing including an exhaust inlet coaxially aligned with the central axis, the outer housing surrounding the inner housing and defining a bypass flow path across the closed end and between the inner and outer housings to bypass a second portion of the exhaust flow around the combustion zone;

an injector tube fixed to one of the inner housing and the outer housing and being in communication with a cavity of the inner housing; and an igniter mount fixed to one of the inner and outer housings and having an aperture adapted to receive an igniter along an igniter axis intersecting the central axis at an angle other than ninety degrees, wherein the igniter axis and the injector tube intersect the central axis at substantially the same angle from opposite sides of the burner .

9. The burner of claim 8 wherein the igniter mount is fixed to a conically shaped portion of the outer housing.

10. The burner of claim 9 wherein the inner housing includes an aperture extending therethrough at a location downstream of the closed end to allow the first portion of exhaust flow to enter the combustion zone.

11. The burner of claim 10 wherein the bypass flow path directs exhaust over an outer surface of the injector tube.

12. The burner of claim 11 further including a mixer combining both the first and second portions of the exhaust flow.

* * * * *